United States Patent [19]

Sgroi

[11] 4,262,893

[45] Apr. 21, 1981

[54] APPARATUS EFFECTIVE TO TENTER CLOTHES IN SUPERIMPOSED LAYERS

[76] Inventor: Vincenzo Sgroi, Via A. Volta, 54, 20052 Monza, Italy

[21] Appl. No.: 44,634

[22] Filed: Jun. 1, 1979

[30] Foreign Application Priority Data

Jun. 9, 1978 [IT] Italy ..... 24390 A/78

[51] Int. Cl.[3] ..... B65H 29/46

[52] U.S. Cl. ..... 270/31

[58] Field of Search ..... 270/31, 30; 83/488-500; 26/7

[56] References Cited

U.S. PATENT DOCUMENTS

| | | | |
|---|---|---|---|
| 2,908,493 | 10/1959 | Obedin | 270/31 |
| 3,672,662 | 6/1972 | Grimm et al. | 270/31 |
| 3,779,541 | 12/1973 | Stumpf | 270/31 |
| 3,811,669 | 5/1974 | Benson et al. | 270/31 |
| 3,951,398 | 4/1976 | Stumpf | 270/31 |
| 4,183,514 | 1/1980 | Off et al. | 270/31 |
| 4,193,589 | 3/1980 | Frederick | 270/31 |

*Primary Examiner*—E. H. Eickholt

*Attorney, Agent, or Firm*—Bucknam and Archer

[57] ABSTRACT

An apparatus for tentering cloths or fabrics on benches in superimposed layers is described, which comprises a motorized carriage capable of longitudinally sliding, by a reciprocating motion, on bench rails and carrying the rolls of fabric or cloth to be deposited on the bench in a tentered form. The carriage comprises a base adhering to the rails and a turret mounted above the base, capable of rotating through at least 180° about a vertical axis. The turret comprises a supporting cloth roll for the axis and a depositing roller. The apparatus also comprises means for driving the rotation of the depositing roller, simultaneously with the shiftings of the carriage, and for depositing on the bench cloth portions having a length equal to the shiftings of the carriage, and means responsive to the cloth or fabric shifting, at the depositing roller, in order to drive the cloth roll in such a manner as to unwind the cloth, in relation to the depositing roller rotation. The apparatus also comprises a transversal cutting assembly, mounted on the turret. The rotation of the depositing roller is driven by a pulse incremental source, associated to a wheel, mounted on the base and clutch engaged on the bench rail, for measuring the effective longitudinal shifting of the carriage and the corresponding rotation of the depositing roller. A horizontal plate is provided to carry the turret, and this plate may be transversely shifted, by a reciprocating movement, above the base, in order to permit a selvedge aligning of the bench tentered cloth layers.

17 Claims, 7 Drawing Figures

APPARATUS EFFECTIVE TO TENTER CLOTHES IN SUPERIMPOSED LAYERS

The present invention relates to an apparatus, effective to tenter cloth in superimposed layers, onto benches or tables, for cloth making industries.

As it is known, in the cloth or garment making industries, in general, before the cutting operation, the clothes are tentered, in superimposed layers, suitably aligned, in order to form the so called "mattress".

In order to carry out this preliminary operation, are nowadays used benches or tables of great length, thereon is mounted, in such a way as to be able of longitudinally sliding, a carriage provided with a cutting device, effective to carry out transversal cuts in the cloth and with supporting means for the cloth roll which has to be unwound.

On that same bench or table are furthermore located transversal detent elements, or stop elements, effective to cause the tentering carriage to stop and return as it reaches predetermined end of stroke positions.

This transversal detent elements are conventionally provided with pliers, extending all along the width of the bench, or table, in such a way as to fix the cloth at the aforesaid end of stroke position, therein that same cloth is normally bent in order to allow for a zig-zag tentering operation to be carried out (in some cases the cloth may be cut, if required, at the end of stroke positions).

In the most improved nowadays used tentering carriages. is provided a supporting member for the cloth rolls, the supporting memmer rotating about a vertical central axis, in such a way that the cloth may be reversed for example as clothes are to be tentered alternatively with the right side or reverse side upwardly directed.

The tentering operation of the cloth is carried out by causing the carriage to slide, after having suitably fixed the end of the cloth, by means of end of stroke detent members, in such a way as to provide the unwinding, by traction, of the cloth from the supplying cloth rolls.

These known apparatuses, however, have many drawbacks, among which, firstly, that of subjecting the clothes to a certain traction action in the unwinding direction, which may cause, particularly in the most delicate clothes, intolerable longitudinal deformations, and defects in the sides due to a stretching of the textile material.

Furthermore, the provision of the end of stroke stopping elements, involves a remarkable time loss, particularly as it is necessary to frequently vary the length of the several superimposed cloth layers.

Another drawback of the known apparatuses is the difficulty of the setting of the apparatuses, as the cloth rolls on the carriage are changed or replaced.

These changes, in fact, require, each time, the ends of the clothes to be tentered to be manually inserted through transmission rollers mounted on the carriage, after having removed the possibly remained cloth of the preceding piece.

Those same operations of "un-trimming" and "trimming" of the carriage have to be carried out as it is desired to rotate the cloth roll supporting member, for example for a tentering operation by alternated layers, with the right face and the reverse one upwardly oriented or directed.

Furthermore, for aligning the superimposed cloth layers, which aligning has to be carried out at the selvedge, frequently transversal cloth stretching occurs, and, accordingly, the clothes may be remarkably damaged, in particular in the case in which delicate clothes are treated.

In fact, in the known apparatuses, this type of selvedge aligning is carried out by shifting or moving the cloth supplying roll in the direction of the axis thereof in such a way that in the cloth length provided by the same roll for supplying the mattress tentered on the bench, are caused transversal stretchings, not always being tolerated by the unwinding piece.

Furthermore, in the known apparatuses, the replacing or change of the rolls on the carriages requires a series of rather fatiguing manual operations involving rather lengthy periods of time which negatively affect the production cost.

The main object of the present invention is to eliminate the hereinabove mentioned drawbacks of the known apparatuses, by providing an apparatus for tentering clothes in superimposed layers on benches or tables, effective to prevent any transversal or longitudinal cloth stretchings from occurring and effective to carry out, in a practically completely automatic way, the tentering operations on the cloth, with the possibility of programming any types of preparations, in layers of the clothes, both in an even mattress arrangement and in a step arrangement.

Another important object of the present invention is to allow for the clothes to be tentered on benches without locating on said benches any detent members, thereby simplifying and accelerating the apparatus setting or adjusting step.

Yet another important object of the present invention is to obtain an automatic type of operation, even in the initial steps of winding and recovering of the pieces, during the changes, or as it is necessary to reverse or turn over the tentered cloth.

These and other objects, which will become more apparent from the following description, are achieved by the apparatus for tentering clothes in superimposed layers on benches, according to the present invention, comprising a motorized or driven carriage, longitudinally sliding, according to a rectilinear reciprocating type of movement, on the rails of a bench and supporting the cloth rolls, to be located on said bench in a tentered arrangement.

The apparatus is characterized in that the aforesaid carriage comprises a base adhering to the rails and a turret, mounted on that same base, with the possibility of rotating through at least 180° about a vertical axis.

The aforesaid turret comprises, at the top thereof, motorized or driven supporting means effective to support a cloth roll mounted with a substantially horizontal axis and, at a lower position, a locating roller, also motorized or driven, having a substantially horizontal axis, thereon the cloth from said cloth roll is caused to adhere at a portion of the extension thereof.

The apparatus comprises, furthermore, means effective to drive in rotation the locating roller, precisely at the occurring of the carriage longitudinal movement in order to locate or deposit on said bench cloth length having a length equal or corresponding to the shiftings of the carriage, and means responsive to the cloth movement or shifting, at the locating or depositing roller, for driving in rotation the cloth roll in the unwinding direction thereof, depending on the depositing or locating roller rotation.

In this way, the cloth is not stretched, during the tentering operation, by the supplying roller, as it occurs in the known type of apparatus, but being located on the bench, in a proportional way to the carriage movement, by rotation of that same roll, and of the aforesaid locating roller, both motorized, without causing cloth or fabric longitudinal stretchings.

Advantageously, according to a further characteristic of the present invention, it is provided for the forming of a cloth loop between the supplying roll and the locating roller, at which loop are mounted detecting means, preferably of the photocell type, which, depending on the extension of said loop, drives the motor controlling the rotation of the hereinabove indicated cloth roll supporting means in such a way as to maintain at a substantially constant value the depth of said loop.

According to another characteristic of the invention, the transversal cutting assembly is mounted on the turret or tower with a possibility of height shifting up to a maximum raising position at which the turret is free of rotating, with respect to the base, about said vertical axis, while motor means are provided for automatically drive that same turret rotation.

Preferably, the rotation of the locating or depositing roller is driven by an incremental type of pulse generator or source, which is associated to a wheel mounted on the base and clutch operated on the bench rail in order to measure the effective longitudinal shifting movement of the carriage and the corresponding rotation of the locating or depositing roller.

Further characteristics and advantages of the invention will become more apparent from an examination of the detailed description of a preferred but not exclusive embodiment of the instant apparatus for tentering clothes in superimposed layers on benches, in the garment making industries, the apparatus being illustrated as a non limitative example only in the accompanying drawing, in which.

Figure 1:
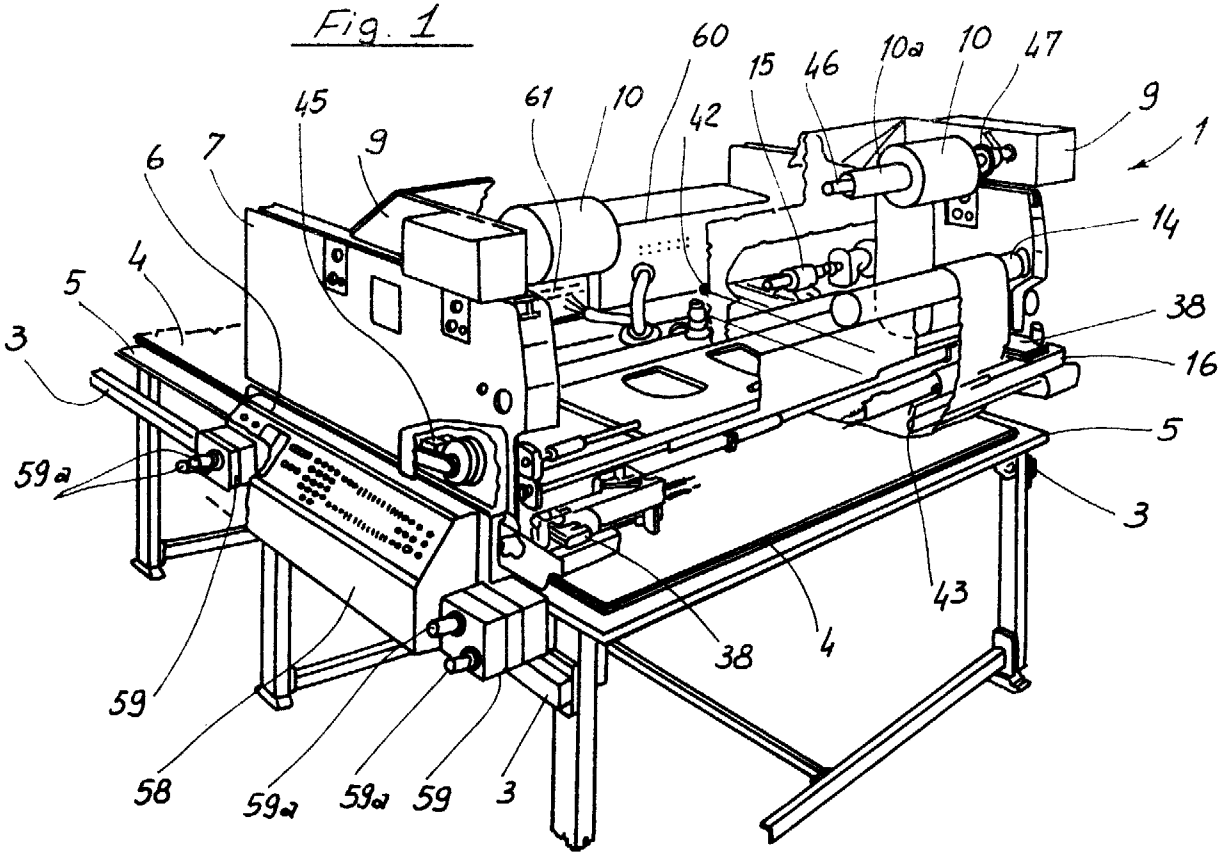
FIG. 1 is a cut-away perspective view illustrating the carriage included in the apparatus according to the present invention; the carriage being seen from the front portion thereof.

Referring particularly to the number references of the figures, at (1) has been overally indicated a carriage, provided at the lower portion thereof with wheels (2) sliding on horizontal rails (3) laterally rigid with a conventional horizontally extending bench, of the type commonly used in the cloth making shops, for depositing cloth or fabric superimposed layers for forming the so called "mattress" (4).

More precisely, said mattress is formed on a horizontal resting plane (5) which, preferably, is at a level slightly greater than that of the aforesaid rails (3).

The same mattress is used in the subsequent cutting and cloth making operations.

The carriage (1) comprises: a driven or motorized base (6), provided with wheels (2); a turret (7) mounted on said base with a possibility of rotating, in both directions, through at least 180° about a vertical axis (8); and a slide (9) located above the turret and horizontally reciprocating parallel to the rails (3).

The roll pieces (10) are mounted with a horizontal axis, one at a time, on the slide (9) in such a way that the clothes may be unwound from the rolls to be caused to rest on the resting plane (5) on which the mattress is formed.

Figure 3:
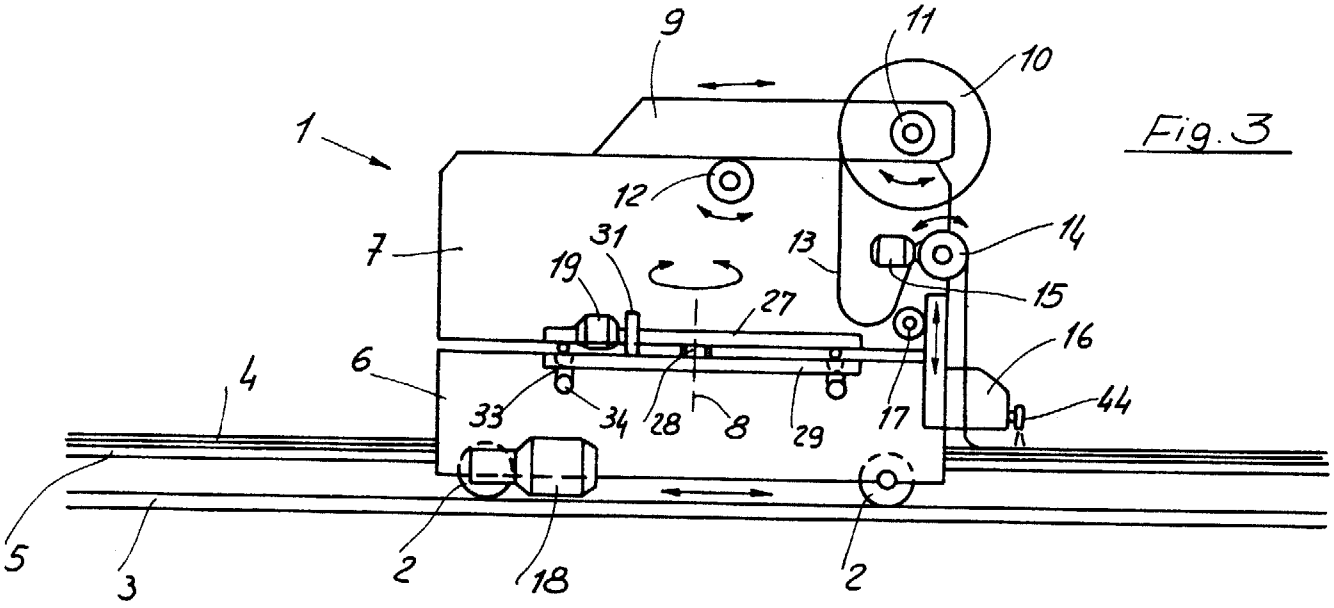
FIG. 3 is a functional diagram of the carriage.

As it is schematically illustrated in FIG. 3, the piece (10) mounted on the slide (9) is rotated by a motor (11) the rotation direction thereof may be reversed, while the slide (9) may be moved, in both directions, by means of a motor (12).

The cloth unwinding from the piece (10), mounted on the slide (9), forms at first a loop (13) and then passes on a depositing or supplying roller (14), wrapping the roller for about 180°.

The depositing or locating roller is mounted, with a horizontal axis, on the turret (7) parallel to the axis of the piece (10) and is driven by a motor (15), in a direction which may be reversed. After the passage on the roller (14), the cloth passes through an assembly (16) comprising a transversal cutting device, of known type, and mounted on the turret (7) capable of vertically reciprocating, being driven by a motor, (17), in such a way that the cutting device height may be fitted to that of the mattress (4) and all the aforesaid assembly (16) may be raised above the base (6) in order to permit the rotation of the turret (7) about a vertical axis (8), as it will be thereinbelow described.

In the diagram of FIG. 3 are furthermore illustrated the motor (18) driving the translation of the base (6) along the rails (3) and the motor (19) which, by means of a clutch system, drives the swinging rotation, through 180°, of the turret (7) about the vertical axis (8).

Figure 4:
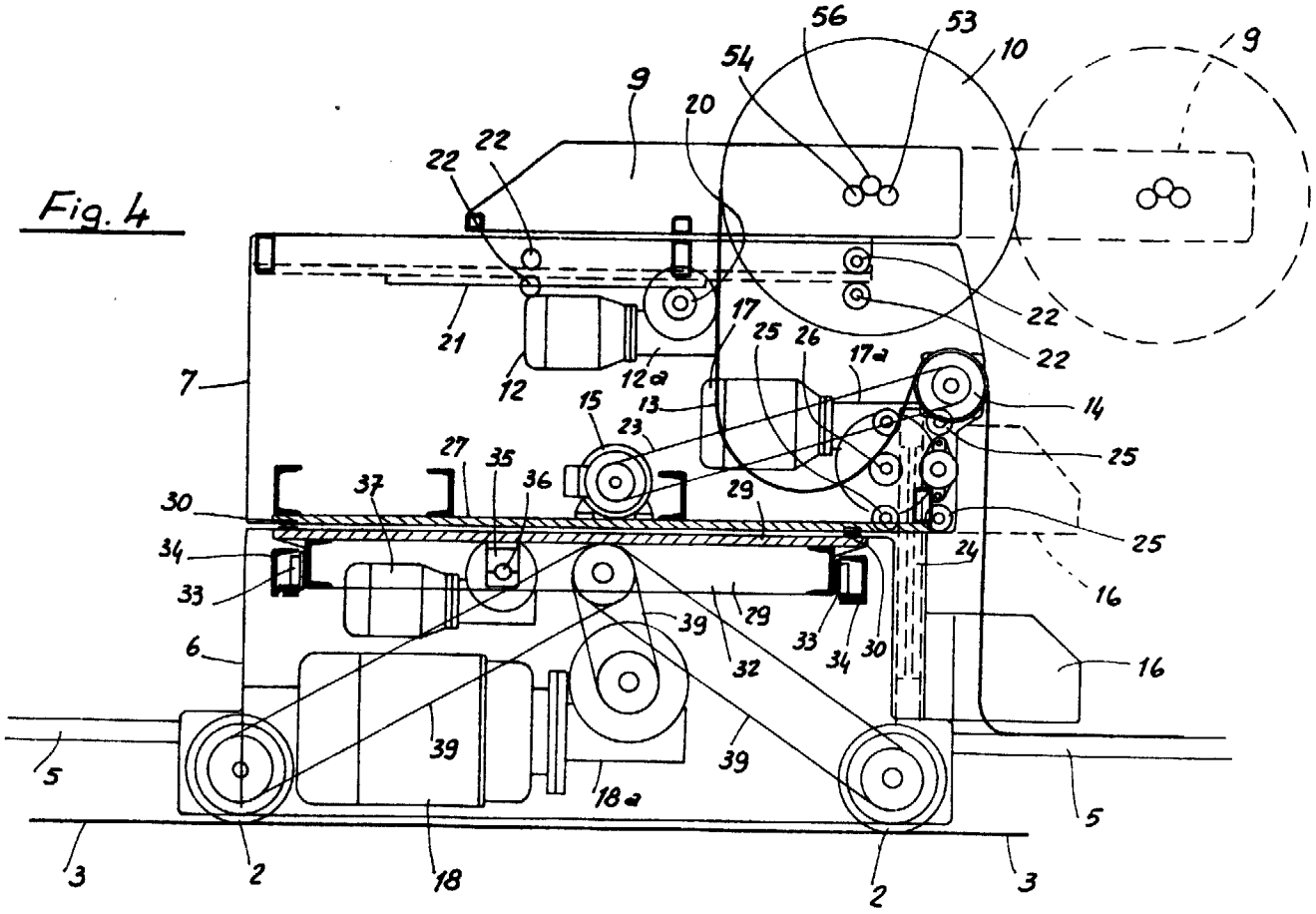
FIG. 4 is a schematical longitudinal section of the carriage.
Figure 5:
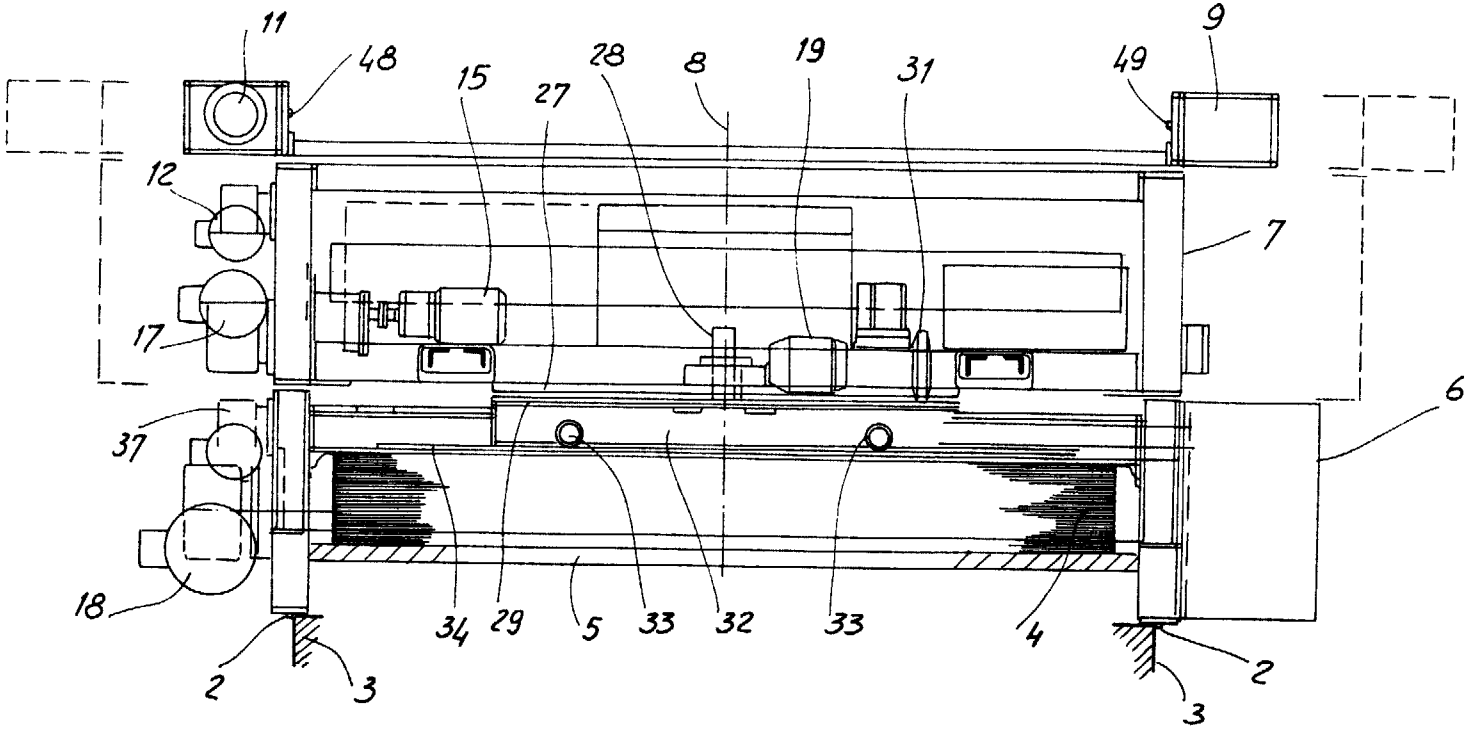
FIG. 5 is a schematic cross-section of the carriage.

The several controls are illustrated in a more detailed way in the sections of FIGS. 4 and 5.

In FIG. 4 is illustrated the slide (9) translation driving system comprising a horizonal axis pinion pair, (20) driven, by a reducer (12*a*) by the aforesaid motor (12) and effective to engage horizontal racks (21) rigid with the slide (9) size, and in turn driven by rollers or bearings (22) as supported by the turret (7).

It is futhermore possible to provide a slide (9) translation system of other type, for example of the oleodinamic type.

In that same FIG. 4 is shown the belt or chain transmission (23) effective to retransmit the movement from the motor (15) to the depositing roller (14), while for the height shifting or adjusting of the cutting device assembly (16) is provided a vertical rack pair (24), rigid with that same assembly, driven by the bearings (25) and effective to engage the pinions (26) rotated by the motor (17) through a reducer (17*a*).

Obviously the heights adjusting or shifting of the assembly (16) may be obtained also by means of another equivalent system, for example a system of the screw and nut-screw type or by means of oleodinamic jacks. In order to rotate the turret (7), this latter is provided at its lower portion with a horizontal plate (27) effective to rotate on a vertical pin (28) (FIGS. 3 and 5) which, in turn, is rigid with another horizontal plate (29) mounted on the base (6); between the plates (27) and (29) are interposed sliding means, for example bearings (30) while those same plates are faced to one another, at a short spacing.

The rotation driving is obtained by a clutch wheel, having a horizontal axis (31), adhering to the upper surface of the plate (29) and driven by said motor (19) while said motor and the clutch wheel (31) are supported by the turret (7), in an eccentrically way with respect to the pin (28).

In this way, the turret (7) may be alternatively rotated through 180°, about the axis (8) of the pin (28), in such a way as to locate the piece (10) mounted on the slide (9) indifferently towards one end or the other of the plane (5) thereon is located the cloth, as it will be thereinbelow described.

In order to selvedge aligning the several cloth or fabric layers deposited on the plane (5), is provided that all the turret (7) may be shifted or moved transversely to the base (6) sliding direction, that is in a direction perpendicular to the rail (3).

To this end, the aforesaid horizontal plate (29) bearing the pin (28) is made rigid with a structure (32) provided with side wheels (33), sliding along horizontal guides or slide-ways (34), FIGS. 4 and 5; this latter is fixed to the base (6), in a transversal direction, that is in a direction perpendicular to the rail (3).

In order to transversely move the turret (7), is provided a nut screw (35) (FIG. 4) fixed to the aforesaid carriage structure (32); in this nut screw is inserted a worm screw (36), the axis of the worm screw (36) being horizontal and perpendicular to the rail (3); the screw (36) is supported by the base (6) and rotated, in both directions, by a motor reducer (37) also supported on the base (6).

The transversal movement of the turret (7) is automatically obtained by means of two photocells (38) (FIG. 1) located on the assembly (16) at the selvedges of the cloth unwinding from the piece (10) mounted on the slide (9).

These photocells drive the thereinabove mentioned motor (37) which rotates the worm screw (36) in such a way as to obtain, on selection, the selvedge aligning on a side or the other of the mattress (4).

Furthermore, in FIG. 4 is illustrated the belt or chain transmission system (29) which serves to bring the movement or transmission to the wheels (2) of the base (6), by deriving said movement or transmission from the motor (18) through a reducer (18*a*).

Obviously this transmission system may be constructed in any suitable way.

According to the invention is furthermore provided that the rotation of the depositing or supplying roller (14) be in a precise synchronization with the translation of the base (6) on the rail (3), in such a way that, during the tentering of the cloth on the plane (5) to each length or movement portion carried out by the base (6), corresponds the deposit of a precisely equal cloth length.

This synchronization may be obtained by a direct kinematic connection between the roller (14) and wheels (2) of the base (6), or, preferably, by an electronic system for driving the aforesaid motor (15) operating the roller (14).

The aforesaid electronic system includes an incremental type of pulse generator or source (40)(FIG. 2) associated to a wheel (41) clutch engaged on the rail (3) for measuring the effective path length of the carriage.

Figure 2:
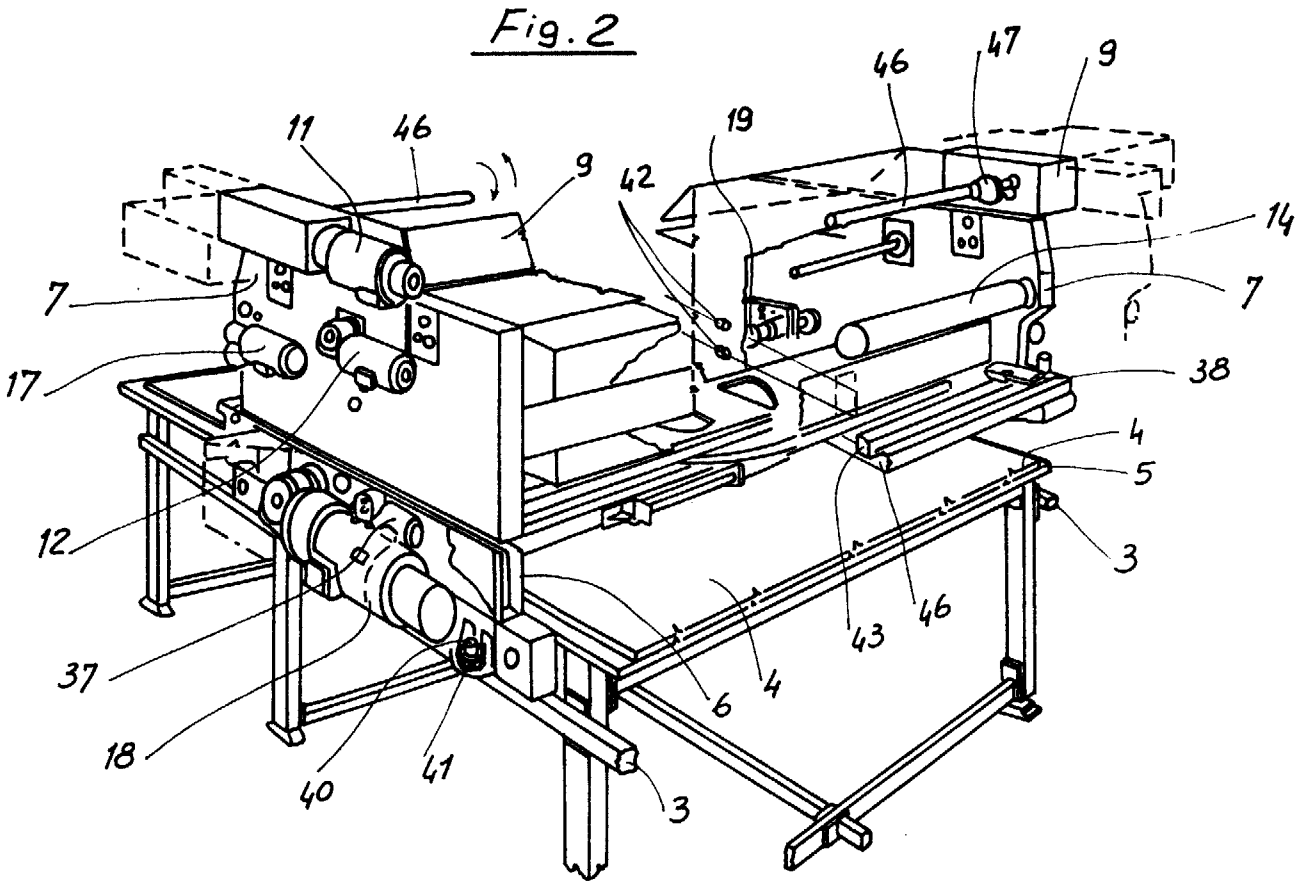
FIG. 2 is perspective view of the carriage, as seen from the rear portion thereof; at the right of FIG. 2 the carriage is shown in the position rotated through 180°.

In the embodiment illustrated in FIG. 2, the wheel clutch engaged on the rail has a vertical axis and acts on the edge of a rail.

It is furthermore possible to associate the incremental type of pulse generator or source (40) to a wheel (2) of the base (6) being however preferable the thereinabove indicated solution with a separated wheel (41) in order to prevent errors due to a possible skidding of the wheels (2) on the rail (3).

The pulses of the incremental source drive the motor (15) in such a way as to obtain the cloth deposit according to layers which are precisely equal to the shiftings of the base (6) on the rail (3).

The driving of the piece (10) mounted on the slide (9), provided by the motor (11) is related to the rotation of the depositing roller (14), by means of a photoelectric system for controlling the cloth or fabric loop (13).

In the embodiment illustrated in FIGS. 1 and 2 are provided two reflection photocells (42) superimposed at a short spacing from one another and horizontally directed towards the cloth or fabric loop (13) in such a way as to control said motor (11) for maintaining nearly constant or unchanged that same cloth loop (13), while said cloth or fabric is deposited on the plane (5).

Before the depositing, or locating, the cloth passes through the assembly (16) comprising the cutting device.

This assembly comprises also a transversal or clothes pliers formed by two paraller horizontal rods (43) located at a short spacing from one another and shiftable, one with respect to the other, between the rods being caused to pass the cloth unwound from the piece (10). As it is necessary, the rods (43) are located adjacent to one another, for example by means of pneumatic jacks or other equivalent means, in order to retain the cloth on the assembly (16). This permits to obtain the automatic rotation of the turret (7) and accordingly to start again the cloth tentering under the preceding conditions as it will be described in a more detailed way thereinafter.

Furthermore to the assembly (16) is associated a reflection photocell, indicated by (44) in the diagram of FIG. 3, effective to drive the motor (17) for automatically adjusting the height of the assembly with respect to the increasing thickness of the mattress (4) through the automatic control assembly indicated at (45) in FIG. 1.

In order to drive the cloth pieces (10) shafts (46) are provided (FIGS. 1 and 2), thereon are threaded the paperboard tubes (10*a*) on which are wrapped those same pieces; these tubes are locked on the shafts (46) by means of end cones (47) supported by said shafts.

The ends of each shaft (46) are provided with square cavities thereinto may be inserted two square head pins (48) and (49) (FIG. 7) associated to the slide (9) sides.

As it is shown in FIG. (7), which illustrates with a partially sectional plan view the two sides (9*a*) and (9*b*) of the slide (9), the pins (48) and (49) are opposingly located, according to a common horizontal axis, parallel to the axis of the depositing roller (14).

Said pins may be mutually approached or moved away by means of suitable double effect pneumatic jacks (50) cooperating with a lever (51) which, through sleeves (52), causes a reciprocating axial shifting of the pins.

In this way, by operating the pneumatic jacks (50), the pins (48) and (49) may be inserted into the square cavities formed in the piece bearings shafts (46) upon resting the shafts on two roller pairs (53), (54) located in the inside of the sides (9a) and (9b) of the slide (9).

In order to unload the pieces (10), in each said roller pair (53)–(54) a roller (54) is mounted in such a way that it is possible to shift said roller (54) by a double acting pneumatic jack (55) mounted with a slanted axis with respect to the vertical direction, in order to provide a horizontally aligned arrangement for the rollers (53) and (54) for supporting the pieces, or an arrangement with the rollers (54) in a lowered position for discharging or unloading said pieces.

Figure 7:
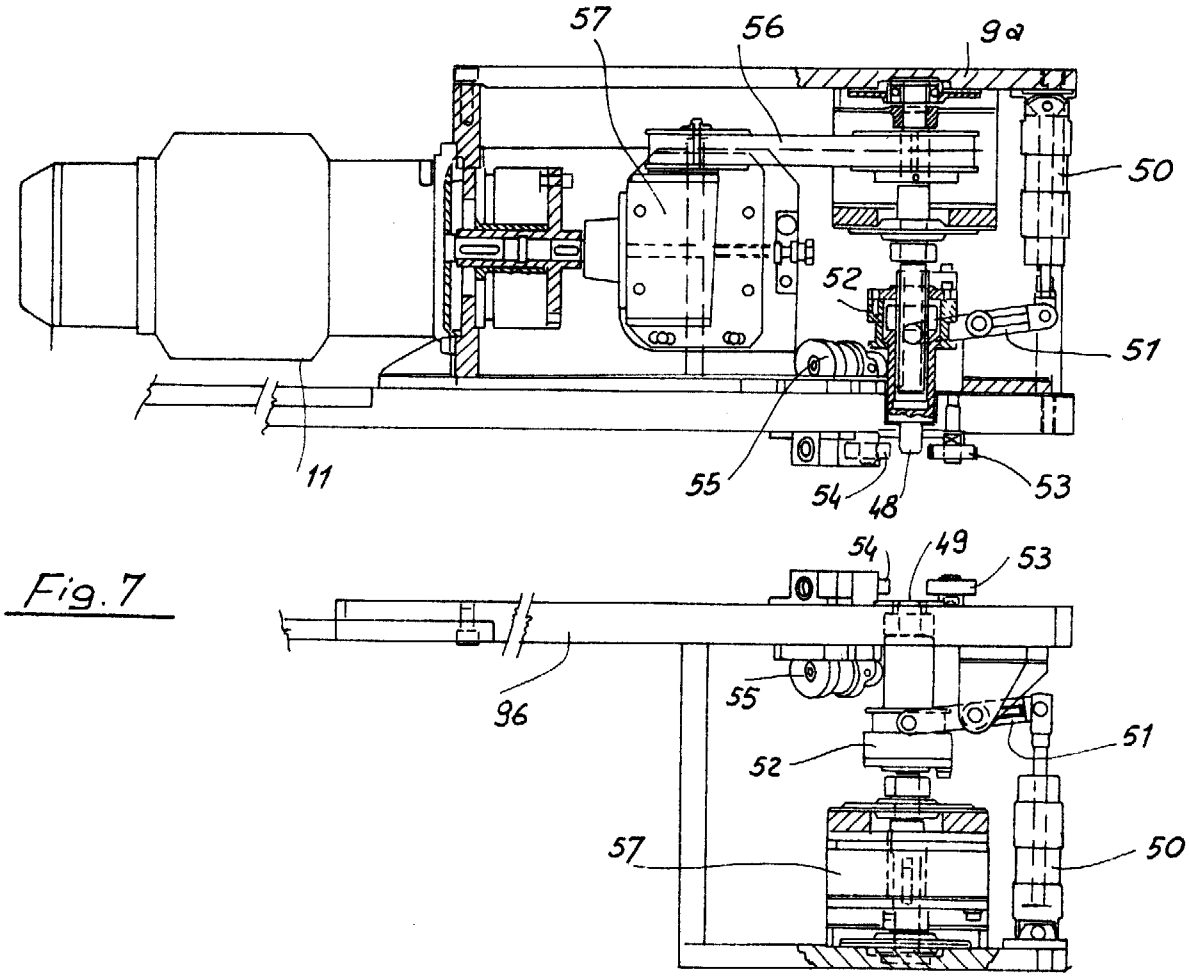
FIG. 7 is a plan view illustrating the partially cross-sectioned detail of the supporting member and the roll piece driving device on the carriage.

The square head pin (48) is driven by means of the aforesaid motor (11) through a belt transmission (56) and a transmission element (57) the overall assembly being mounted on the side (9a) of the slide (9) as it is illustrated in FIG. 7.

The other square head (49) is normally idle rotating on the other side (9b) of the slide (9) and is associated to an electromagnetic brake (57) effective to prevent the piece carried by the slide from undesirably unwinding.

All of the several commands of the movable parts, mounted on the carriage (1) and the translation movement of the carriage itself and the loading-unloading or discharging system (which will be described thereinafter) may be suitably programmed by means of electronic programming apparatus mounted on the base (6) indicated at (58) in FIG. 1, which may be of the card, pushbutton or like type.

At the left and right of the electronic apparatus (58) are furthermore provided (FIG. 1) two manual command sets (59).

Each set or assembly is provided with two knobs (59a) effective, respectively, to provide the carriage 1 translation and piece (10) unwinding for carrying out the calibration steps of the apparatus in order to test the operation or to eliminate cloth defects.

In FIG. 1 are furthermore illustrated a cabinet for the service electric apparatus (60) and a cabinet for the service pneumatic apparatus (61), as mounted on the turret (7).

With respect to the elimination of the cloth or fabric defects, is provided a signalling and stop mechanism, (not shown in the drawings) which provides for the fixing, on the piece selvedge, of "metalized" or similar bands at the defects.

A detector for said "metalized" bands, the detector being advantageously of the photocell or similar type, is furthermore installed on the carriage (1) for acoustically and/or optically signalling the defects and for the simultaneous automatic stopping of the apparatus, in order to permit to eliminate defective cloth or fabric portions.

The invention also provides an automatic piece (10) loading and unloading or discharging device, cooperating with the slide (9) which, during the loading and discharging operations, is caused to translate on the turret (7), by causing the slide to project therefrom, as illustrated with the dashed lines in FIG. 4.

Figure 6:
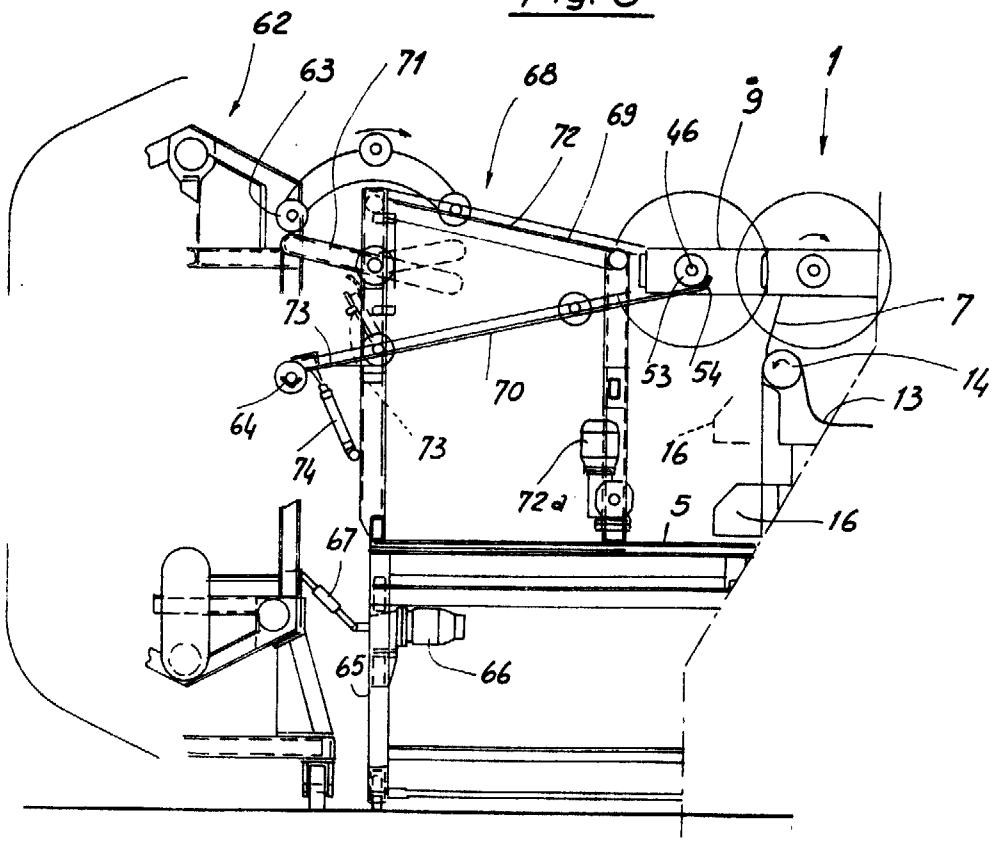
FIG. 6 is a side view of the device for loading and unloading roll pieces.

This loading and unloading device is schematically illustrated in FIG. 6 and provides for the use of a support or carousel magazine for the pieces, said carousel magazine being of the vertical carriage type, known of itself, indicated at (62) in the same figure.

Said support or carousel magazine (62) for the pieces (10) may support a remarkable roll number, the rolls being parallel located with the axis thereof horizontally extending, being provided with vertically extending annular paths or tracks the pieces may be moved, while maintaining parallel located to one another, in such a way as to bring the pieces to a loading position, indicated at (63), or in such a way as to bring the related housing seats to a discharging position, indicated at (64).

The carousel support (62) is carried at one end of the bench or table (65) where is mounted an electric motor (66) effective to drive, through a cardan connection (67), the piece shifting mechanism in said support (62).

The motor (66), in turn, is suitably driven by the aforesaid electronic programming apparatus (58) in such a way as to operate according to the programmed sequences.

On the plane (5) of the bench, is mounted, at the end, a frame (68) supporting two superimposed chutes (69) and (70) respectively a loading and discharging chute, to which is flanked the carriage (1) during the loading-discharging steps, as illustrated in FIG. 6.

The upper chute (69) is slanted in such a way that the lower loading chute (70) is directed upwardly towards said carriage, in such a way that the top end thereof is at the level of said slide.

The pieces (10) are predisposed on the support (62) as already threaded on the related shafts (46).

For the loading operation, furthermore, is provided on the frame (62) a swinging arm pair (71), said swinging arms (71) being simultaneously actuated by driving aerodinamic means or other equivalent means in such a way as to grip or withdraw a piece (10) from the position (63) of the support (62) in order to bring said piece on the chute (69).

More precisely, the piece is deposited by the arms (71) on conveying chains (72) located at the chute (69) and driven by a motor (72a) in such a way as to bring said pieces towards the carriage (1) without rotating the pieces.

In the last portion of the chute (69), the pieces roll, by gravity until the ends of the shafts (56), supporting said pieces, rest on supporting rollers (53) and (54) mounted on the slide (9).

This latter is suitably approached to the frame (62) as it is shown in FIG. 6.

As a piece or the core of a piece has to be discharged from the slide (9), the supporting rollers (54) are automatically shifted or moved, in such a way as to obtain a gravity discharging along the chute (70).

The end portion (73) of the discharging or unloading chute (70) is of the tilting type, the tilting being obtained by means of an oleodinamic cylinder (74); in this way the discharging chute may be raised, as indicated by the dash line in FIG. 6, in order to form a detent for holding at a rest position the pieces and the piece cores to be discharged, as, for example is not yet ready the housing seat at the position (64) of the support (62).

Obviously the loading and discharging operations of the pieces may be carried out at both ends of the bench, by equipping the ends with the motor (66) and frame (62) and by rotating the turret (7) in such a way as to present the slide (9) to the frame (68) with the proper position.

The operation of the apparatus thereinabove described is the following.

After having loaded a piece (10) on the slide (9), in the manner described hereinabove the square head pins (48) and (49) are automatically moved, in the mutual approaching direction, said pins (48) and (49) being inserted in the respective hollows or cavities formed at the ends of the shaft (46) supporting that same piece.

Said piece may be motorized or driven by the motor (11) in order to obtain the automatic trimming of the carriage (1).

This trimming is determined, in addition to the motor (11) operation, also by the motor (12) which shifts or moves the slide (9), the motor (15) operating the depositing roller (14) and possibly the motor (17) vertically shifting the assembly (16).

More precisely, the cloth or fabric is caused to descend from the piece (10), while the slide (9) is moved by the piece withdrawing projecting position (FIG. 6) to the operative position superimposed on the turrett (7) as it is illustrated by a full line in FIG. 4 or in the schematic FIG. 3.

While the slide (9) causes the turret (7) to withdraw, the cloth, or fabric, as it is unwound from the piece, is caused to rest on the depositing roller (14) and then, by continuing the piece unwinding operation, is formed the loop (13).

At this time also the depositing roller (14) starts to rotate, the roller causing the initial portion of the piece to descend towards the assembly (16) until the same initial portion arrives at the proximity of the plane (5).

Simultaneously start to operate the photocells (42), for controlling the loop (13), in such a way as to hold constant this latter, by switching on or off in a suitable way the motor (11) which rotates the piece (10).

In this way is obtained the automatic trimming with the slide (9) at an operative withdrawn position and the cloth unwound in the initial part thereof, as far as the proximity of the table (5).

At this time may bé started the tentering of the cloth, after the carriage as reached the tentering operation starting position, which position will be preliminarly programmed in the electronic apparatus (58) and which, accordingly, does not request any pre-locating of detent members on the bench.

The tentering operation is carried out by causing the carriage (1) to translate along the rail (3), the wheel (41) clutch-engaged on the rail actuating the pulse incremental source (40) which, in turn, causes the rotation of the depositing roller (14) by the motor (15).

As hereinabove stated, to each movement of the carriage, that is to each rotation of the wheel (41), corresponds a synchronized movement of the depositing roller (14), in such a way that on the plane (5) is deposited a cloth length precisely equal, in extension, to the carriage translation.

In the meanwhile the photocells (42) will drive the motor (11) in order to maintain nearly constant the cloth loop extension, in such a way that the piece is unwound without subjecting to any tension the unwound cloth.

Accordingly, the tentering operation of the cloth or fabric on the plane (5) is carried out by means of a simple depositing operation, without any tension on the cloth, with respect to the movement of the carriage (1), which may be moved on the rail (3) indifferently in both directions.

Upon having tentered a cloth layer, the carriage (1) is caused to stop, the transversal pliers (43) closed and the cloth transversal cutting step, is carried out by means of the cutting device mounted on the assembly (16).

This cutting device, (not shown) may be of any known type.

Then the carriage is automatically brought to the tentering operation starting position, upon having opened the transversal pliers (43); then another cloth layer may be deposited in an analogous way as hereinabove described.

Obviously during the carriage recovering step, the cloth is not unwound from the piece, unless a tentering operation is carried out with bent layers zig-zag superimposed onto one another and having uncut ends.

By operating in this same way, are tentered all of the programmed layers, in such a way as to completely form the mattress (4).

If a cloth turning over operation is provided for example for tentering alternated layers with the right and reverse portions upwardly directed, the turret (7) is automatically rotated, based on the program, through 180°.

To do this, upon having cut the cloth, the transversal pliers (43) is closed and the assembly (16), supporting said pliers and the cutting device, is caused to raise up to a maximum rising position at which said assembly is located on the base (6), as illustrated in FIG. 4.

Is then possible to cause the turret (7) to rotate through 180° in order to bring the piece (10), depositing roller (14) and assembly (16) on the carriage side opposed to that at which the preceding tentering operation has been carried out.

Then the assembly (16) is caused to lower, the pliers (43) opened again, for example in the time period in which the carriage translated to reach the tentering operation starting position and then may be tentered the subsequent layer which will be reversed with respect to the preceding one.

By operating in this way, superimposed layers may be tentered, the layers being alternatively reversed (for example face to face) or according to a right and reverse arrangement programmed at will.

With the increasing of the thickness of the mattress being formed, the assembly (16) is automatically raised on command by the reflection photocell (44) mounted on the same assembly.

As stated the selvedge aligning is carried out by means of the control provided by the photocells (38) mounted on the assembly (16) which photocells drive the transversal shifting of all the turret (7) for example as it is illustrated by dashed lines at the right portion of FIG. 2, thereby determining a transversal translation not only of the piece (10) but also of the depositing roller (14) and assembly (16) in such a way that any transversal stretching on the cloth is prevented.

In the known systems, on the contrary, it occurs only the piece transversal shifting, with inevitable cloth transversal stretchings.

As it should be apparent, the apparatus according to the invention permits to carry out an automatic cloth superimposed layer tentering operation without requiring the locating, on the bench, of end of stroke detent members as it is requiring in the known apparatuses.

Furthermore the apparatus according to the invention may be programmed for an automatic tentering operation of step mattress of any shape.

A like tentering operation is greatly difficult in the known apparatuses and, in same cases, it may not be obtained.

As a new piece has to be mounted on the carriage, for example as the preceding piece has been exhausted or as another type of cloth has to be tentered, the apparatus automatically carries out the unloading and loading operations, bringing the carriage to the position near to the frame (68) as it is shown in FIG. 6 and operating all the several commands, obviously after having located the carousel support (62) at the proximity of the frame (68) and after having connected the motor (66) to said support by means of the connection (67).

The discharging or unloading and loading operations are carried out as thereinabove described.

Then, the carriage (1) may be moved or shifted, possibly by rotating through 180° the turret (7), in order to locate the carriage at the programmed position for tentering the yet loaded cloth or fabric.

When a cloth roll which is not yet exhausted has to be removed from the carriage, first the carriage has to be trimmed, the trimming operation being carried out automatically by reversing the rotation direction of the motor (11).

The trimming operation is automatically carried out, depending on the needs, by suitably shifting or moving the slide (9) with respect to the turret (7).

When, during the cloth tentering operation, a defect occurs preliminarily detected by a metallized band or the like applied to the cloth selvedge, then the signalling and automatically stopping device operates.

Subsequently the defective cloth lengths may be eliminated by manually operating the knob (59*a*) and by executing suitable cuts, by means of the cutting device associated to the assembly (16).

After having removed the defective cloth length, the apparatus automatic operation may be started again.

The apparatus according to the invention may be used for tentering a piece cloth, of any type: open, bent, tubular and so on.

It is also possible to use the instant apparatus for tentering the clothes or fabrics in the zig-zag arrangement, by carrying out the cutting operation at the mattress ends, upon having completed the forming thereof.

Obviously the invention has not to be considered as limited to the sole hereinabove illustrated embodiment, being possible several other embodiments based on the same inventive concept.

Thus, for example, the piece discharging and loading device may be realized by means of conveying belts or raising means as combined with any type of magazine.

I claim:

1. An apparatus for tentering cloths or fabrics on benches in superimposed layers, particularly for the garment industry, comprising a motorized carriage, effective to longitudinally slide, by a reciprocating movement, on bench rails and carrying the rolls of fabric or cloth to be deposited on said bench in a tentered form, wherein said carriage comprises a base adhering to said rails and a turret mounted above said base, with motor means of rotation through at least 180° about a vertical axis, said turret comprising, at the top portion thereof, motorized supporting means capable of supporting a cloth roll mounted about a substantially horizontal axis, and, at a lower portion, a depositing roller, also motorized or driven, being mounted about a substantially horizontal axis, thereon is caused to adhere, for a part of the extension thereof, the cloth from said cloth roll, said apparatus comprising, furthermore, means for driving the rotation of the depositing roller, simultaneously with said reciprocating movement of the carriage, for depositing on the bench cloth portions having a length equal to said reciprocation of the carriage, and means responsive to the cloth or fabric movement, at the depositing roller, in order to rotatively drive the cloth roll in such a way as to unwind said cloth, in relation to the depositing roller rotation.

2. An apparatus according to claim 1, wherein said apparatus provides for the forming of a cloth loop between the cloth roll and the depositing roller, at said loop being mounted detecting means, the photo-cell type which, depending on the extension of that same loop, drives the motor rotating said means for supporting said cloth roll, in such a way as to maintain the depth of said loop substantially constant.

3. An apparatus according to claims 1 or 2 wherein said apparatus comprises a transversal cutting assembly, mounted on said turret, means for effecting height shifting up to a maximum raising position, at which position said turret is free of rotating, with respect to the base, about said vertical axis, while said motor means are provided for automatically driving said turret rotation.

4. An apparatus according to claim 1, wherein the rotation of the depositing roller is driven by a pulse incremental source, associated to a wheel, mounted on the base and clutch engaged on the bench rails, for measuring the effective longitudinal shifting of the carriage and the corresponding rotation of the depositing roller.

5. An apparatus according to claim 1 wherein said base is provided, at the top thereof, with a horizontal plate on which rotatively is carried said turret, while said motor means alternatively rotate said turret through 180° with respect to said base.

6. An apparatus according to claim 5, wherein said horizontal plate carrying said turret is transversely shifted above said base in a reciprocal manner by shifting means thereby permitting selvedge aligning of the bench tentered cloth layers, said shifting means being slaved to detecting means of the photocell type, said apparatus further including a transversal cutting assembly, said detecting means being mounted on said transversal cutting assembly.

7. An apparatus according to claim 6 wherein said transversal cutting assembly is provided with transversal pliers, driven by oildynamic cylinders, and with means for passing the cloth to be tentered through said pliers.

8. An apparatus according to claim 7, wherein said transversal cutting assembly is provided with a detector, of the reflection photocell type, said apparatus further including a motor for raising and lowering said assembly, said detector actuating said last mentioned motor, in order to automatically adjust the height of that same assembly, depending on the increasing thickness of the said superimposed layers.

9. An apparatus according to claim 7, wherein said motorized or driven supporting means effective to support the cloth or fabric rolls are mounted on a slide having means for causing said slide to horizontally reciprocate to aid in loading and discharging of said cloth rolls, said slide horizontally reciprocating on said turret in order to bring said supporting motorized means to a position projecting from said turret, during the loading and discharging steps of the cloth rolls or the related cores.

10. An apparatus according to claim 9, wherein said cloth rolls are locked on shafts the ends thereof engaging pins provided on said motorized supporting means for rotating said cloth rolls.

11. An apparatus according to claim 10, wherein during the said loading of the cloth roll, the ends of said shafts rest on supporting elements, rigid with the slide sides, said supporting elements being partially movable in order to permit the automatic discharging of the cloth rolls.

12. An apparatus according to claim 11, wherein said apparatus comprises a signalling and automatic stop device, responsive to metal bands, applied on the cloth selvedge, for signalling possible defects, thereby permitting detection of the corresponding defective cloth lengths.

13. An apparatus according to claim 10, wherein said apparatus comprises a device for automatically loading and discharging the cloth or fabric rolls, which device comprises a frame to be mounted on at least one bench end, having two chutes, respectively a loading and discharging chute, substantially located at the height of said slide, while to that same frame is associated a cloth roll magazine, of the vertical carousel type, effective to be actuated by a motor.

14. An apparatus according to claim 13, wherein said loading chute is provided with chain means, for advancing the cloth rolls towards said slide, without causing said cloth rolls to rotate about the axes thereof, while the end portion of said chute is located at the level of motorized supporting means, mounted on the slide; said loading chute being additionally provided with at least a swingable arm for taking up said cloth rolls from said magazine.

15. An apparatus according to claim 13, wherein said discharging chute ends, at the top thereof, at the level of said motorized supporting means for receiving the cloth rolls while at the lower portion of that same discharging chute is provided a movable detent member effective to retain, at the resting position, the discharged rolls.

16. An apparatus according to claim 15, wherein said apparatus further includes an electronic programming device to control said transversal cutting assembly, said turret motor control and said automatic cloth roll loading and discharging device.

17. An apparatus according to claim 16, wherein said electronic programming device is mounted on the carriage base.

* * * * *